US008427323B2

(12) United States Patent
Alper et al.

(10) Patent No.: US 8,427,323 B2
(45) Date of Patent: Apr. 23, 2013

(54) MONITORING SYSTEM

(75) Inventors: Paul Alper, Wynnewood, PA (US); Shaun Kerry Matthews, Gaddesby (GB)

(73) Assignee: Pibed Limited, Denby, Ripley, Derbyshire (GB)

( * ) Notice: Subject to any disclaimer, the term of this patent is extended or adjusted under 35 U.S.C. 154(b) by 166 days.

(21) Appl. No.: 12/823,475

(22) Filed: Jun. 25, 2010

(65) Prior Publication Data

US 2011/0316701 A1 Dec. 29, 2011

(51) Int. Cl.
*G08B 21/00* (2006.01)

(52) U.S. Cl.
USPC ..... 340/573.1; 340/521; 340/3.1; 707/722; 707/769; 707/E17.014

(58) Field of Classification Search ..... 340/573.1; 707/722, 769
See application file for complete search history.

(56) References Cited

U.S. PATENT DOCUMENTS

| | | | |
|---|---|---|---|
| 5,370,267 | A | 12/1994 | Schroeder |
| 5,625,659 | A | 4/1997 | Sears |
| 5,945,910 | A | 8/1999 | Gorra |
| 6,065,639 | A | 5/2000 | Maddox et al. |
| 6,125,482 | A | 10/2000 | Foster |
| 6,392,546 | B1 | 5/2002 | Smith |
| 6,404,837 | B1 | 6/2002 | Thompson et al. |
| 6,542,568 | B1 | 4/2003 | Howes, Jr. et al. |
| 6,577,240 | B2 | 6/2003 | Armstrong |
| 6,707,873 | B2 | 3/2004 | Thompson et al. |
| 7,242,307 | B1 | 7/2007 | LeBlond et al. |
| 7,271,728 | B2 | 9/2007 | Taylor et al. |
| 7,372,367 | B2 | 5/2008 | Lane et al. |
| 7,734,476 | B2 | 6/2010 | Wildman et al. |
| 7,783,380 | B2 | 8/2010 | York et al. |
| 2001/0054038 | A1 | 12/2001 | Crevel et al. |

(Continued)

FOREIGN PATENT DOCUMENTS

| | | | |
|---|---|---|---|
| WO | 03082351 | A2 | 10/2003 |
| WO | 2005093681 | A1 | 10/2005 |

(Continued)

OTHER PUBLICATIONS

International Search Report (PCT/GB2011/051206), completed Aug. 25, 2011.

(Continued)

*Primary Examiner* — Tai T Nguyen
*Assistant Examiner* — Ojiako Nwugo
(74) *Attorney, Agent, or Firm* — Hill & Schumacher

(57) ABSTRACT

A group monitoring system for dispenser usage compliance is provided. The system is for a predetermined group of interest in a predetermined facility type. A dispenser data collection system is operably connected to a plurality of dispensers and is capable of providing information. The information includes a unique dispenser identifier and a number of dispenser usage events. The information from the data collection system is received and the predetermined group within which each dispenser is associated is determined. The number of dispenser usage events is determined. A benchmark which corresponds to dispenser usage opportunities particular to the predetermined group and particular to the predetermined time period is determined. The dispenser usage compliance index particular to the predetermined group and particular to the predetermined time period is determined by dividing the dispenser usage events for the predetermined group and the predetermined time period by a denominator which equals the benchmark.

37 Claims, 11 Drawing Sheets

U.S. PATENT DOCUMENTS

| | | | | |
|---|---|---|---|---|
| 2002/0135486 | A1 | 9/2002 | Brohagen et al. | |
| 2002/0150198 | A1 | 10/2002 | Thompson et al. | |
| 2004/0001009 | A1 | 1/2004 | Winings et al. | |
| 2005/0154612 | A1 | 7/2005 | Smith et al. | |
| 2006/0132316 | A1 | 6/2006 | Wildman et al. | |
| 2007/0008146 | A1 | 1/2007 | Taylor et al. | |
| 2007/0182571 | A1 | 8/2007 | Kennish et al. | |
| 2007/0229288 | A1 | 10/2007 | Ogrin et al. | |
| 2008/0266113 | A1* | 10/2008 | Kennish et al. | 340/573.1 |
| 2009/0189759 | A1 | 7/2009 | Wildman et al. | |
| 2009/0195385 | A1 | 8/2009 | Huang et al. | |
| 2009/0204256 | A1 | 8/2009 | Wegelin | |
| 2009/0273477 | A1 | 11/2009 | Barnhill | |
| 2010/0153374 | A1* | 6/2010 | LeBlond et al. | 707/722 |
| 2010/0164728 | A1 | 7/2010 | Plost | |
| 2010/0170052 | A1 | 7/2010 | Ortins et al. | |
| 2010/0173581 | A1 | 7/2010 | Dolan | |
| 2010/0188228 | A1 | 7/2010 | Hyland | |
| 2011/0169643 | A1* | 7/2011 | Cartner | 340/573.1 |

FOREIGN PATENT DOCUMENTS

| | | | |
|---|---|---|---|
| WO | 2006133114 | A1 | 12/2006 |
| WO | 2006135922 | A2 | 12/2006 |
| WO | 2007133960 | A2 | 11/2007 |
| WO | 2010026581 | A2 | 3/2010 |
| WO | 2010034125 | A1 | 4/2010 |

OTHER PUBLICATIONS

Crosby, Cynthia T., "Hand hygiene: are we doing better?(Infection Protection)," Healthcare Purchasing News, Dec. 1, 2005, pp. 1-3, HighBeam Research.

"Wireless Monitoring of Hand Hygiene Compliance," IHygiene, Woodward Laboratories.

Morgan, Dennis A. et al., "A computer software application for managing occupational exposure data," American Industrial Hygiene Association Journal, Oct. 1998, vol. 59 No. 10, pp. 723-728, ProQuest Info & Learning 2010.

Desorbo, Mark A., "Hands for Hygiene," Food Quality, Apr./May 2005, pp. 22-26.

Larson. L. Elaine et al., Hand Hygiene Behavior in a Pediatric Emergency Department and a Pediatric Intensive Care Unit: Comparison of Use of 2 Dispenser Systems, American Journal of Critical Care (AJCC) 2005, vol. 14 pp. 304-311.

Boyce, John M. et al., "Evaluation of an Electronic Device for Real-Time Measurement of Alcohol-Based Had Rub Use," Infection Control and Hospital Epidemiology, Nov. 2009 vol. 30, No. 11, The Society for HealthCare Epidemiology of America, Sep. 23, 2009.

"A Legacy for Leaders: Opportunities in Six Sigma and Lean for HealthCare Providers & Suppliers," Creative Healthcare (CHC), 2005 pp. 1-24.

Doty, Laura, "Food Safe Helping Hands," Foodservice Equipment & Supplies, Mar. 1, 2005.

"DPAC Technologies to Showcase OEM Implementation of Airborne Wireless LAN Node Module at the Medical Design & Manufacturing Conference and Expo," Business Wire, Jan. 5, 2004, HighBeam Researcher.

LeBlond, Claude, "Woodward Laboratories Announces the Release of IHygiene," Woodward Laboratories, Jan. 4, 2004.

Sax, Hugo et al., "The World Health Organization Hand Hygiene Odservation Method," Article in Press, Sep. 30, 2009.

Lazarus, Ian R. et al., "Six Sigma raising the bar," Special Report, Managed HealthCare Executive, Jan. 2003.

Lazarus Ian R. et al., "Six Sigma enters the HealthCare mainstream," Special Report, Creative HealthCare, 2004.

Lazarus, Ian R. et al., "Providers, Payers and IT Suppliers learn it pays to GET LEAN," Creative Healthcare (CH) Feb. 2006.

Observation Form, "Patent Safety, Save Lives Clean Your Hands," World Health Organization, revised Aug. 2009.

Perlik, Allison, "Keeping Safety in Hand.(Brief Article)," Restaurants & Institutions, HighBeam Research, Apr. 1, 2001.

Pittet, Didier, "Improving Adherence to hand Hygiene Practice: A Multidisciplinary Approach," Special Issue, Emerging Infectious Diseases vol. 7, No. 2, pp. 234-240, Mar./Apr. 2001.

* cited by examiner

MONITORING SYSTEM

FIELD OF THE INVENTION

This invention relates to dispenser usage and in particular to a method of monitoring dispenser usage which can be correlated to hand hygiene compliance or other dispenser usage compliance.

BACKGROUND OF THE INVENTION

The spread of healthcare acquired infections also known as HAI's has been an ever increasing challenge in health care facilities. HAI's include the transmission of bacteria, viruses and other disease-causing micro-organisms from various sources such as a patient or environmental surfaces to another patient or surface via the hands of healthcare workers which results in an infection of a patient that was previously not infected. These problems have been more apparent in recent years with the SARS (severe acute respiratory syndrome) outbreak and the influenza A virus H1N1 pandemic. As well, health care facilities have battled MRSA (methicillin-resistant staphylococcus aureus) and VRSA (vancomycin-resistant staphylococcus aureus) and other drug resistant micro-organisms for many years. Accordingly, there is a need to ensure that health care professionals comply with hand hygiene best practices. Hand hygiene can be accomplished using liquids such as a sanitizing product which does not require water or rinsing off or alternatively it can be accomplished using a soap and water.

As well there are other types of liquids that can be dispensed such as sun screen wherein the use of the sun screen similarly needs a method of monitoring, tracking and reporting. For example such a method could be very important in schools in Australia where the incidences of skin cancer are very high.

SUMMARY OF THE INVENTION

In a first aspect, there is provided a group monitoring system for dispenser usage compliance within a predetermined group of interest in a predetermined facility type comprising the steps of: providing a plurality of dispensers, providing a dispenser data collection system operably connected to each dispenser, capable of providing information, the information including a unique dispenser identifier for each dispenser, a number of dispenser usage events that each dispenser was used; receiving the information from the data collection system and determining the predetermined group within which each dispenser is associated; determining the number of dispenser usage events within the predetermined group within a predetermined time period; determining a benchmark which corresponds to dispenser usage opportunities particular to the predetermined group and particular to the predetermined time period; calculating a dispenser usage compliance index particular to the predetermined group and particular to the predetermined time period by dividing the dispenser usage events for the predetermined group and the predetermined time period by a denominator wherein the denominator equals the benchmark.

The number of dispenser usage events within a predetermined time period may equal a number of times the dispenser has been activated however a plurality of activations within a predetermined activation period is considered a single dispenser usage event. The predetermined activation period is typically between 1 and 4 seconds.

The information may include the type of product in the dispenser and the type of product is typically one of hand soap, sanitizer, lotion, cream, sunscreen and body wash.

The predetermined time period may be one of a shift, a weekday, a weekend day, a holiday day each of the predetermined group in the predetermined facility type.

The benchmark may vary depending on the predetermined facility type. The predetermined facility type may be one of a health care facility, a food processing facility, a food service facility, an educational facility and a manufacturing facility. Alternatively, the predetermined facility type may be one of a teaching hospital, a non-teaching hospital, a long term care facility, rehabilitation facility, a free standing surgical center, a health care professional office, a dental office, a veterinarian facility and a community care facility.

Similarly, the benchmark may vary dependent on predetermined group of interest. The predetermined group of interest may be one of a medical unit, a surgical unit, a critical care unit, an intensive care unit, an emergency care unit, a pediatric unit, an emergency unit, an outpatient unit, a specialty care unit, a dermatology unit, an endocrinology unit, a gastroenterology, an internal medicine unit, an oncology unit, a neurology unit, an orthopedic unit, an ophthalmic unit, an ear nose and throat unit, a neonatal unit, an obstetrics and gynecology unit, a cardiac unit, a psychiatric unit, a post-operative recovery unit, a radiology unit, a plastic surgery unit and an urology unit. The predetermined group may be one of a bed, a room, a ward, a unit, a floor, a facility and a hospital group.

The benchmark in the denominator may be multiplied by census data. The census data may be one of bed occupancy rate in the predetermined group, patient days in the predetermined group, patient visits in the predetermined group, bed-hours of care in the predetermined group and staff in the predetermined group.

The group monitoring system for dispenser usage compliance may include the step of determining a hand hygiene compliance index. The hand hygiene compliance index may include information from dispenser usage only; weighted information from the dispenser usage compliance index and one of survey compliance data or direct observation compliance data. Alternatively, the hand hygiene compliance index includes weighted information from the dispenser usage compliance index and survey compliance data and direct observation compliance data.

The dispenser data collection system may use a frequency chosen from the group consisting of between 400 and 450 MHz system, between 850 and 950 MHz system and between 2.4 and 2.5 GHz. Alternatively, the dispenser data collection system may be a hard wired system.

The dispenser data collection system may use a frequency between 850 and 950 MHz system and has a transmission power of up to 1000 milliwatts. The dispenser data collection system may include a plurality of hubs for receiving data from the plurality of dispensers. Each hub receives data from up to 10,000 dispensers and the distance between each dispenser and its associated hub is no greater than 5740 feet. The data may be encrypted.

In another aspect of the group monitoring system for dispenser usage data collection comprising: a plurality of dispensers each having a sensor operably attached thereto for collecting data from the dispenser; a plurality of hubs capable of receiving data from a plurality of dispensers; and wherein the data is transmitted at between 850 and 950 MHz.

The data may be encrypted. Each dispenser may have a power usage of up to 1000 milliwatts.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
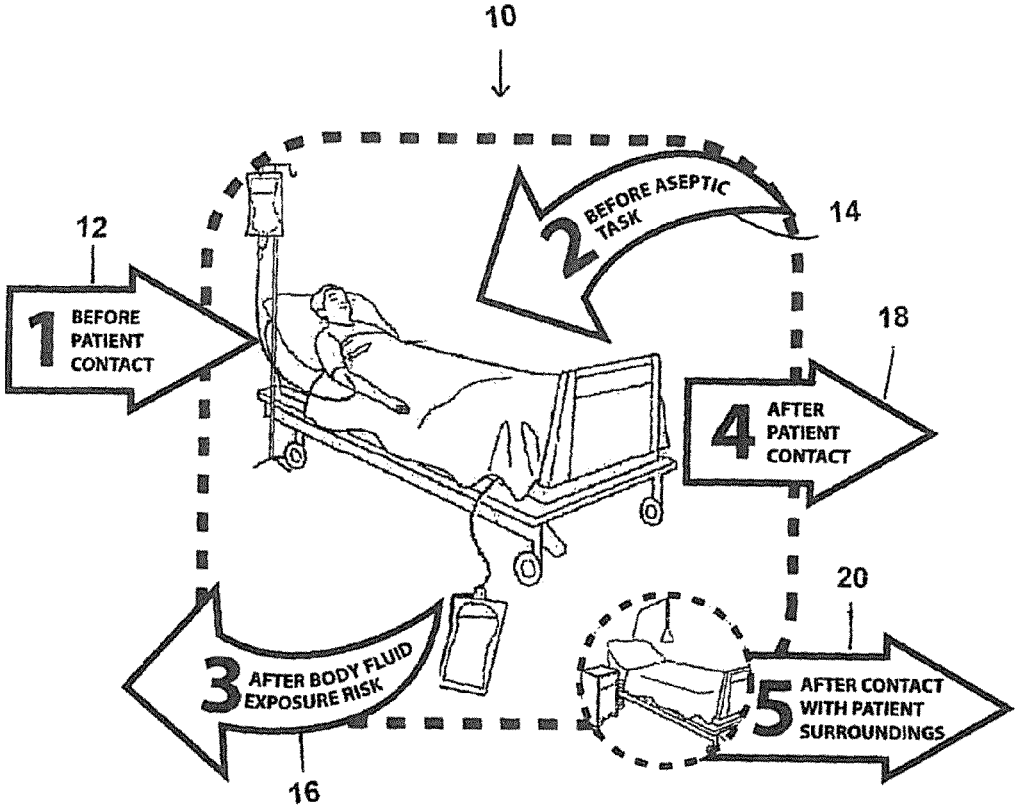
FIG. 1 is a sketch showing the five moments for hand hygiene in a healthcare setting.

Measuring healthcare worker adherence to hand hygiene compliance guidelines is not a simple matter. There are no proven standards or benchmarks that may be used. However there is a very clear need to monitor and measure hand hygiene compliance. Accordingly there is a need to determine whether or not a hand hygiene action occurred when there was an indication for a hand hygiene action. The five moments for hand hygiene actions in a healthcare setting are shown in FIG. 1. These five moments of hand hygiene were developed by the World Health Organization. Hand hygiene actions can be sanitizing with a sanitizing product which does not require water or rinsing off or alternatively it can be washing with soap and water.

Referring to FIG. 1 the five moments of hand hygiene action are shown generally at 10. Specifically they are before patient contact 12, before aseptic task 14, after body fluid exposure risk 16, after patient contact 18 and after contact with patient surroundings 20. When considering compliance, if a health care worker only washes or sanitizers his or her hands, 6 out of the 10 times that they should have, they are said to exhibit a compliance rate of 60%.

There are a number of ways to measure compliance namely direct observation, remote observation, self-reporting and dispenser usage data or product usage data. Each way has its own benefits and challenges. Specifically direct observation provides specific information on hand hygiene behaviors, techniques and indication. However, the labor and resources required to collect such data is intensive. Generally if this type of data is collected it is only collected for a small sample of the total of hand hygiene opportunities and thus has a typically low level of statistical reliability. The data is subject to bias from over or under sampling of certain shifts and units. As well, it has been shown that there are also issues regarding inter-rater (observer) reliability and therefore it is difficult to compare the results from one observer or rater with another.

Further, it has been shown that if people know they are being watched or studied there is a greater likelihood that the compliance rate will be artificially higher than in reality. This is known as the Hawthorne Effect. Evidence supporting this is found in a 2009 German study that compared product usage data with direct observation data and found that the direct observation compliance rate was 2.75 times higher than that for product usage. Thus product usage is gaining acceptance by professionals as a more accurate measure of true compliance rates.

In regard to remote observation such as video the advantage is that it is less subject to bias and it can operate at any time of day or night and in any unit. However, such a method of data collection is expensive because of the installation and maintenance of the video equipment as well as the time to review the video, such review is then subject to the same lack of inter-rater reliability as direct observation. Further, it can be subject to bias based on the video location. Further, there may be privacy issues in regard to video locations.

In regard to the self-reporting option, this has the advantage of being low cost and it encourages health care workers with respect to hand hygiene self-awareness. However, in general this type of data collection has poor reliability and most experts in the field consider this method of little, if any, value.

In typical healthcare environments, hand hygiene liquids are stored and dispensed onto the hands from dispensers, therefore there is a direct correlation between dispenser usage or activations and hand hygiene events being performed. Dispenser usage data can provide the product volume used per patient day or the number of times the dispenser was used per patient day. This has the advantage of being less costly to monitor. Further, it provides an overall measure of use and it is not subject to selection bias. However, it does not provide feedback for indications or technique. Further, it does not identify low-performing individual staff members. There are a number of further advantages to measuring dispenser usage. Specifically in addition to being less costly it is less resource intense and therefore more efficient than observation. As well it can be done manually or electronically. It allows organization-wide trends to be tracked over time. It can be unobtrusive and designed to take up little additional space. Dispenser usage can be easily measured across all shifts, twenty-four hours a day, and seven days a week. It requires minimal staff training. It can easily be done in many different healthcare settings.

In the embodiments herein the dispensers are capable of determining when the dispensers are activated. The number of dispenser usage events within a predetermined time period equals the number of times the dispenser has been activated and a plurality of activations within a predetermined activation period is considered a single dispenser usage event. It will be appreciated by those skilled in the art that a plurality of activations within a short period of time will typically mean one user has activated the dispensers a plurality of times rather than multiple users activating the dispenser very close together. Therefore, a plurality of activations within a 1 to 4 second time frame will be considered a single dispenser usage event. For hand soaps and hand sanitizers in a healthcare facility, this will typically be set at 2.5 seconds. However, where dispenser usage is being monitored for different types of products indifferent types of facilities, this may be set for a different activation period. Typically dispensers are calibrated to dispense a predetermined amount of liquid for each activation. Accordingly, the dispenser activation directly relates to product usage. Accordingly it will be appreciated by those skilled in the art that when determining a dispenser usage compliance index one could measure volume used or dispenser activations.

In one embodiment dispenser usage alone is used to calculate a dispenser usage compliance index. In another embodiment, a combination of two or more of dispenser usage data, direct observation data and survey data (for example self reporting data or patient survey data) may be used to provide consolidated hand hygiene information. Preferably the information would be automated and in real time. In one embodiment the system would provide automated multi-modal hand hygiene compliance reports. Preferably these reports could be presented by unit and or department. Such automated reporting would provide the hospital's management with the tools to give feedback on compliance adherence; target interventions designed to improve compliance; and reward improved performance.

In one embodiment the hand hygiene compliance index will include a plurality of modes of determining compliance. Specifically it will include data from dispenser usage, observation and/or surveys. Each method is weighted and then combined to create a single index of compliance. The methods are weighted based on, for example, their statistical reliability To determine the measure of compliance by dispenser usage the facility being monitored is provided with a plurality of dispensers. The facility may be divided into predetermined groups of interest. The facility may be a teaching hospital, a non-teaching hospital, a long term care facility, a rehabilitation facility, a free standing surgical center, a health care professional office, a dental office, a veterinarian facility and a community care facility as well as other health care settings in which hand hygiene compliance is an important issue. Alternatively the system herein may be used in any facility wherein the hand hygiene needs to be monitored such as at various stages in food preparation including abattoirs, preparing precooked foods and restaurants. The monitoring system could also be used for monitoring compliance with applying such dispensed lotions as sunscreen.

In order to determine dispenser usage compliance one needs the number of hand hygiene events and a benchmark for a predetermined area or group and for a predetermined time. The dispenser usage compliance is the dispenser usage events divided by a denominator wherein the denominator includes at least in part the benchmark. The benchmark is particular to the predetermined group and particular to the predetermined time period. The usage may be measured for each dispenser in the predetermined group in practically real time and the captured data is transmitted electronically. It will be appreciated by those skilled in the art that there is a limited amount of time required for the data to get from the dispenser, to the hub to the server (described below) but this could be set for the messages to be transmitted very frequently. While access to the reports is available twenty-four hours, seven days a week, typically, however, the reports would most likely be presented no more than daily and more likely weekly or monthly. However, if there was a particular outbreak on a ward the usage of the dispenser could be monitored more frequently by accessing the reports on demand. The number of hand hygiene events within a predetermined time period equals a number of times the dispenser has been activated and wherein multiple activations within a predetermined activation period are considered a single dispenser usage event. It is not uncommon that when someone uses a dispensing system that rather than merely activating once they activate the dispenser multiple times. Accordingly to accurately determine the correct number of dispenser usage events the number of times the dispenser is activated is determined. However where there are multiple activations within a predetermined activation period that is considered a single dispenser usage event. The benchmark is the number of times the dispenser should have been used for a predetermined group over a predetermined time period.

When the dispenser usage compliance relates to hand hygiene compliance in a healthcare facility, the benchmark relates to the five moments of hand hygiene for a predetermined group over a predetermined time period. To determine the benchmark for the predetermined area and time, one needs to determine the hand hygiene occurrences that should occur per patient for the predetermined area and time. This is done with reference to the five moments of hand hygiene as shown in FIG. 1. It will be appreciated by those skilled in the art that the benchmark will be different depending on a number of variables. For example if the healthcare facility is a teaching facility it is likely that more healthcare professionals will need to see the patient and therefore the benchmark may be higher. The benchmark may vary if the predetermined period is a night shift versus a day shift; if it is a weekday versus a holiday or weekend. The benchmark will likely vary depending on the type of unit. For example an intensive care unit will likely have a higher benchmark than an orthopedic unit. The denominator may be dependent on the census data. Specifically to determine the denominator the benchmark is multiplied by the census data. For some healthcare facility units or the predetermined group of interest the census data will be the bed occupancy. In some health care facilities or in particular units of the facility this may always be close to 100% whereas in other units or facilities this may vary greatly. In other units, for example, an emergency unit or an outpatient unit, the census data might be the number of patients seen during the shift or over the predetermined time period that is at issue. It may also be the number of bed-hours of care provided during the predetermined time period that is at issue.

Further, it will be appreciated by those skilled in the art that the benchmark may be determined through experiments or other means by the healthcare facility or there may be default benchmarks provided which are provided to the user by the dispenser provider or a central authority.

The following are some of the categories which may be used to determine the correct benchmark. The group or types set out below that relate to healthcare facilities and the types of units within them are the Center for Disease Control (CDC) location labels and are by way of example only. It will be appreciated by those skilled in the art that there are a number of different ways of dividing up the units in a healthcare facility.

Facility Types—Healthcare

Hospital—non teaching
Hospital—teaching (affiliated with medical school)
Rehabilitation Facility
Long Term Care Facility
Free Standing Surgical Center
Medical/physician office
Dental office
Veterinarian Office Facility Types—Non Healthcare School/educational
Correctional Military
Food service (such as a restaurant)
Food processing (such as a manufacturer of food products)
Pharmaceutical production
Commercial building/organization (such as a manufacturer where workers must apply protective creams routinely)
Other facilities where spread of infections by hands is a concern Adult Critical Care Units Burn Critical Care
Medical Cardiac Critical Care
Medical Critical Care
Medical/Surgical Critical Care
Neurologic Critical Care
Neurosurgical Critical Care
Prenatal Critical Care
Respiratory Critical Care
Surgical Cardiothoracic Critical Care
Surgical Critical Care
Trauma Critical Care Pediatric Critical Care Units Pediatric Burn Critical Care
Pediatric Cardiothoracic Critical Care
Pediatric Medical Critical Care
Pediatric Medical/Surgical Critical Care
Pediatric Neurology Critical Care
Pediatric Neurosurgical Critical Care
Pediatric Respiratory Critical Care
Pediatric Surgical Critical Care
Pediatric Trauma Critical Care Neonatal Units Well Baby Nursery (Level I)
Step down Neonatal ICU (Level II)
Neonatal Critical Care (Level II/III)
Neonatal Critical Care (Level III)

Inpatient Specialty Care Areas

Long Term Acute Care (LTAC)
Bone Marrow Transplant Specialty Care Area
Acute Dialysis Unit
Hematology/Oncology SCA
Solid Organ Transplant SCA
Pediatric Bone Marrow Transplant SCA
Pediatric Dialysis SCA
Pediatric Hematology/Oncology SCA
Pediatric Long-Term Acute Care
Pediatric Solid Organ Transplant SCA Inpatient Adult Wards Antenatal Care Ward
Burn Ward
Behavioral Health/Psych Ward
Ear/Nose/Throat Ward
Gastrointestinal Ward
Gerontology Ward
Genitourinary Ward
Gynecology Ward
Jail Unit
Labor and Delivery Ward
Labor, Delivery, Recovery, Postpartum Room (LDRP)
Medical Ward
Medical/Surgical Ward
Mixed Acuity Ward
Mixed Age, Mixed Acuity Ward
Neurology Ward
Neurosurgical Ward
Ophthalmology Ward
Orthopedic Trauma Ward
Orthopedic Ward
Plastic Surgery Ward
Postpartum Ward
Pulmonary Ward
Rehabilitation Ward
School Infirmary
Surgical Ward
Stroke (Acute) Unit
Telemetry Unit
Vascular Surgery Ward Inpatient Pediatric Wards Adolescent Behavioral Health
Pediatric Burn Ward
Pediatric Behavioral Health
Pediatric Ear, Nose, Throat
Pediatric Genitourinary
Medical Pediatric Ward
Pediatric Med/Surg Ward
Pediatric Mixed Acuity (if patients are of mixed age, use Mixed Age found in Inpatient Adult Wards)
Pediatric Neurology Ward
Pediatric Neurosurgical Ward.
Pediatric Orthopedic Ward
Pediatric Rehabilitation Ward
Pediatric Surgical Ward Step Down Units Step Down Unit
Pediatric Step Down Unit Operating Rooms Cardiac Catheterization Room/Suite
Cesarean Section Room/Suite
Interventional Radiology
Operating Room/Suite
Post Anesthesia Care Unit/Recovery Room Long Term Care Inpatient Hospice
Long Term Care Unit
Long Term Care Alzheimer's Unit
Long Term Care Behavioral Health/Psych Unit
Ventilator Dependent Unit
Long Term Care Rehabilitation Unit Laboratory Identified Event (LabID) Only Facility-wide Inpatient
Facility-wide Outpatient Miscellaneous Areas All Inpatient Beds Combined
Float Sleep Studies (for in and out patients)
Pulmonary Function Testing
Transport Service
Treatment Room

OUTPATIENT LOCATIONS

Acute Care Settings

24-Hour Observation Area
Ambulatory Surgery Center
Facility-wide Outpatient
Mobile Emergency Services/EMS
Outpatient Emergency Department
Outpatient Pediatric Surgery Center
Outpatient Plastic Surgery Center
Outpatient Surgery Recovery Room/Post Anesthesia Care Unit
Pediatric Emergency Department
Therapeutic Apheresis Unit
Urgent Care Center Clinic (Nonacute) Settings Allergy Clinic
Behavioral Health Clinic
Blood Collection Center
Cardiac Rehabilitation Center
Cardiology Clinic
Continence Clinic
Dermatology Clinic
Diabetes/Endocrinology Clinic
Ear, Nose, Throat Clinic
Family Medicine Clinic
Genetics Clinic
Gynecology Clinic
Holistic Medicine Center
Hyperbaric Oxygen Center
Infusion Center
Neurology Clinic
Occupational Health Clinic
Occupational Therapy Clinic
Ophthalmology Clinic
Orthopedic Clinic
Ostomy Clinic
Outpatient Dental Clinic
Outpatient GI Clinic
Outpatient Hematology/Oncology Clinic
Outpatient Hemodialysis Clinic
Outpatient HIV Clinic
Outpatient Medical Clinic
Outpatient Rehabilitation Clinic
Pain Clinic
Pediatric Behavioral Health Clinic
Pediatric Cardiology Center
Pediatric Clinic
Pediatric Dental Clinic
Pediatric Dermatology Clinic
Pediatric Diabetes/Endocrinology Clinic
Pediatric Gastrointestinal Clinic
Pediatric Hematology/Oncology Clinic
Pediatric Nephrology Clinic
Pediatric Orthopedic Clinic
Pediatric Rheumatology Clinic
Pediatric Scoliosis Clinic
Physical Therapy Clinic
Physician's Office
Podiatry Clinic
Prenatal Clinic
Pulmonary Clinic
Rheumatology Clinic
School or Prison Infirmary
Specimen Collection Area (Healthcare)
Speech Therapy Clinic
Surgical Services Clinic
Well Baby Clinic
Wound Center
Wound Ostomy Continence Clinic
Endoscopy Suite
Radiology, includes Nuclear Medicine
Mobile Blood Collection center
Mobile MRI/CT

COMMUNITY LOCATIONS

Blood Collection (Blood Drive Campaign)
Home Care
Home-based Hospice
Location Outside Facility.
Specimen Collection Area (Community)

NON-PATIENT CARE LOCATIONS

Figure 2:
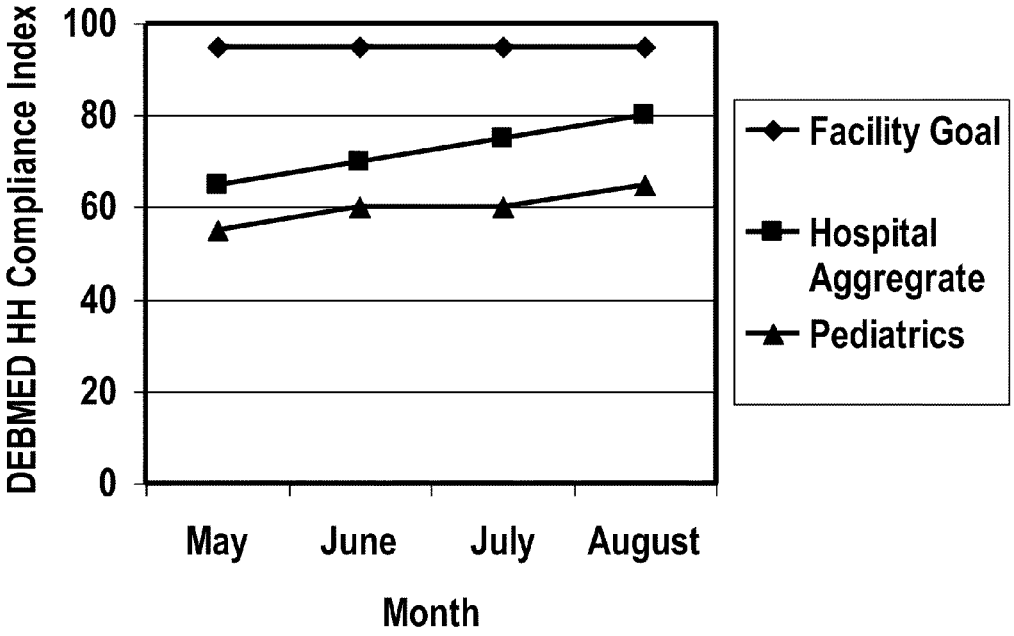
FIG. 2 is a graph showing the compliance index of pediatrics as compared to the facility goal and the hospital aggregate.
Figure 3:
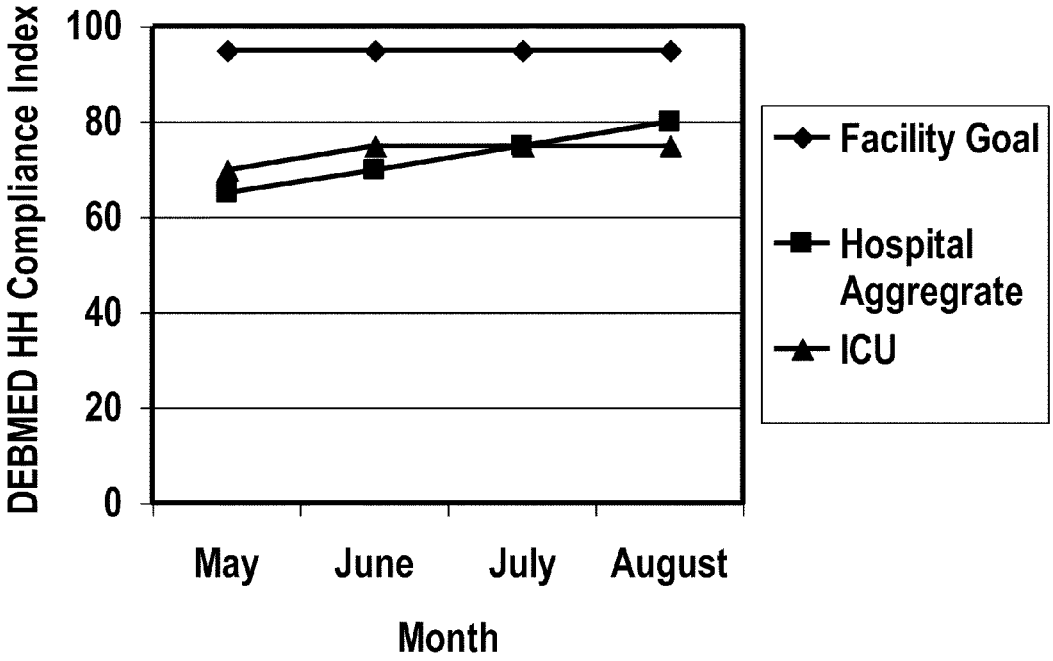
FIG. 3 is a graph showing the compliance index of the intensive care unit as compared to the facility goal and the hospital aggregate.
Figure 4:
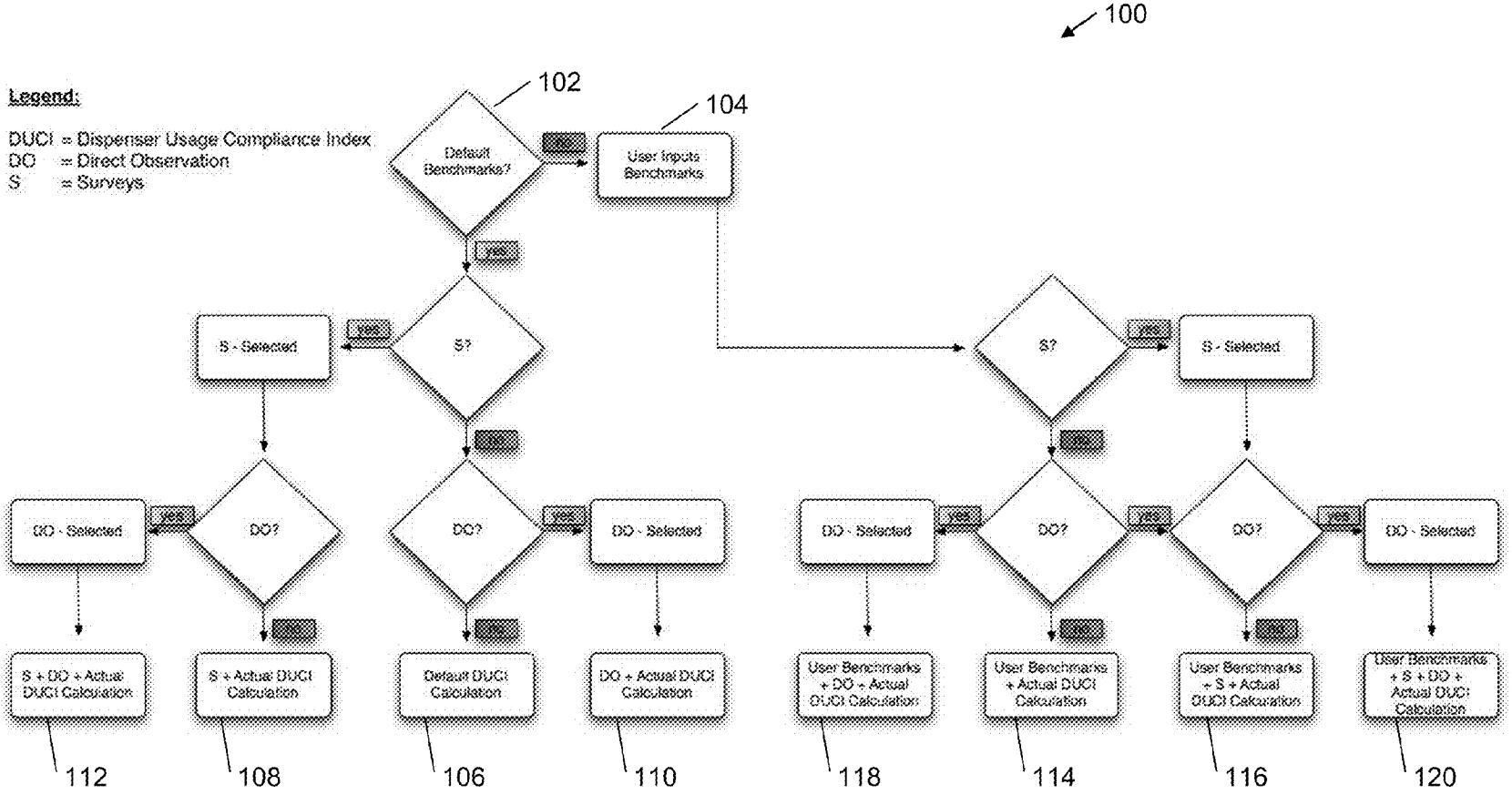
FIG. 4 is flow chart showing different methods for calculating the hand hygiene compliance index.
Figure 5:
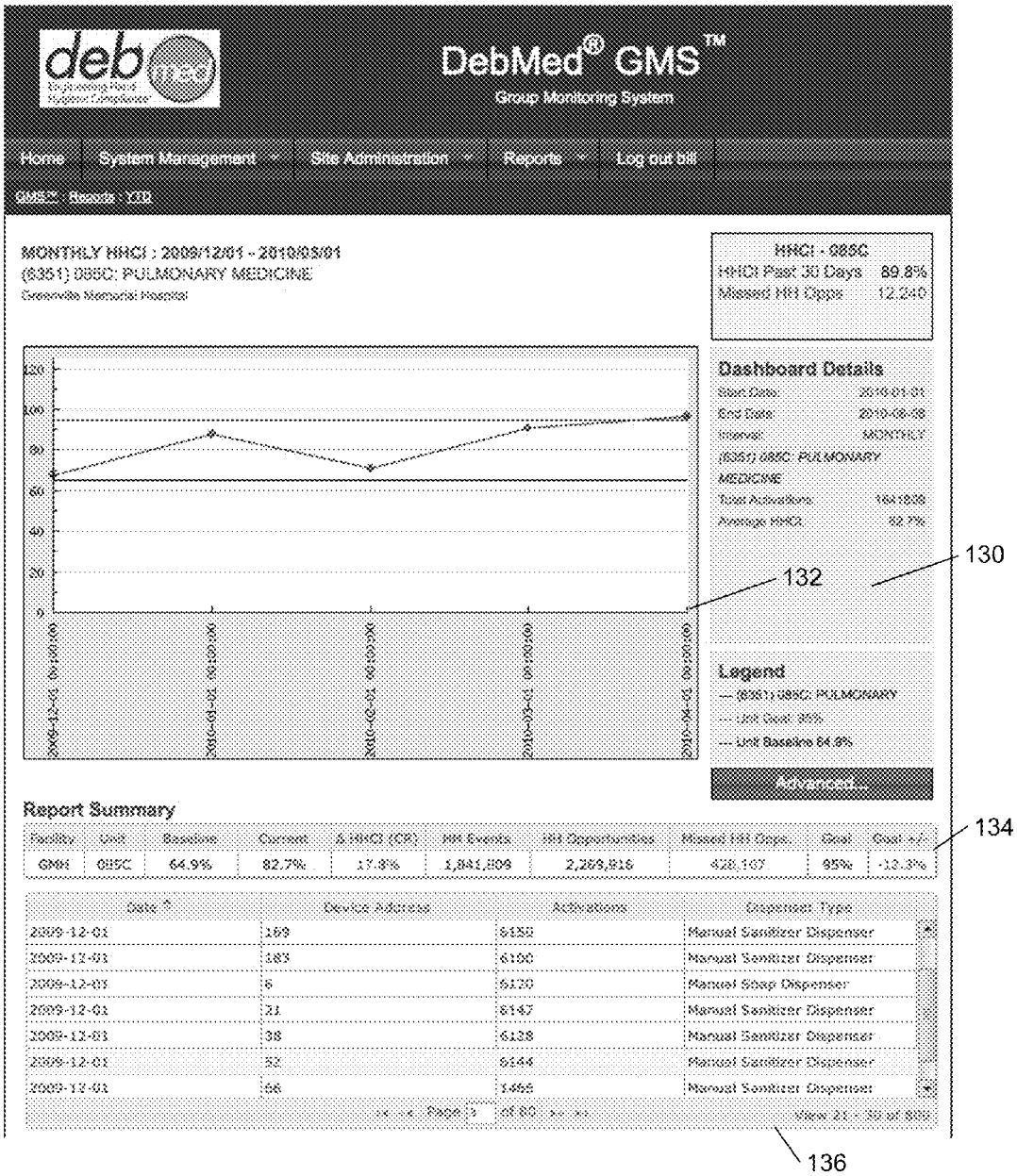
FIG. 5 is a sample dashboard showing an example of the way information may be presented to a user.

Administrative Areas
CDC Locations and Descriptions
Assisted Living Area
Blood Bank
Central Sterile Supply
Central Trash Area
Clinical Chemistry
Facility Grounds
General Laboratory
Hematology Laboratory Histology/Surgical Pathology
Housekeeping/Environmental Services
Laundry Room
Microbiology Laboratory
Morgue/Autopsy Room
Pharmacy
Physical Plant Operations Center
Public Area in Facility
Serology Lab
Soiled Utility Area
Virology Laboratory Day Parts Day shift—weekday/weekend or holidays
Night Shift—weekday/weekend or holidays
First Shift/Second Shift/Third Shift—for both weekdays/weekends or holidays
First Shift/Second Shift/Third Shift/Fourth Shift/Fifth Shift—for both weekdays/weekends or holidays
Predetermined time period during the day Once the multi-modal compliance index is calculated a number of different reports could be generated. The reports can be used to help determine where more or different hand hygiene compliance efforts such as additional training need be implemented. The reports could be presented in a simple graph format as shown in FIGS. 2 and 3 wherein FIG. 2 shows the hand hygiene index in the pediatrics unit as compared to the hospital aggregate and the goal or benchmark and FIG. 3 shows the hand hygiene index in the intensive care unit as compared to the hospital aggregate and the goal or benchmark. FIG. 4 shows some different reporting options. FIG. 5 shows a dashboard showing a more comprehensive way of presenting the information.

It will be appreciated by those skilled in the art that there are a number of different options in regard to how the hand hygiene compliance index may be presented. A representation of the different ways the hand hygiene compliance index may be presented is shown generally at 100 in FIG. 4. For example, the user may use a default benchmark 102 or a user defined benchmark 104 when determining the dispenser usage compliance. With the default benchmark the hand hygiene compliance index may be a dispenser usage compliance index on its own 106 or it may include multi-modal data. If it includes multi-modal data the dispenser usage compliance index may be combined with survey data 108; or with direct observation data 110; or with survey data and direct observation data 112. Alternatively with the user defined benchmark the hand hygiene compliance index may be presented as the dispenser usage compliance index on its own 114; or with survey data 116; or with direct observation data 118; or with survey data and direct observation data 120. If the dispenser usage compliance index is combined with other data the data is weighted when it is combined to provide a hand hygiene compliance index.

The hand hygiene compliance index (HHCI) may be expressed as an equation. Hand hygiene events or dispenser usage events are used for calculation of the HHCI or the dispenser usage compliance index. An event is the same as a dispenser activation, except in the case where multiple activations occur within a predetermined activation period. The predetermined activation period is between 1 and 4 seconds and preferably 2.5 seconds. Wherein multiple activations occur within the predetermined activation period the total activations occurring within the predetermined activation period constitute a single hand hygiene event. In those cases multiple activations within for example 2.5 seconds are recorded as a single event with n activations. The events are what are used for the HHCI numerator.

(\frac{\sum_{s}^{e}events}{\sum_{s}^{e}(census_{dp}*benchmark_{dp})}*w_1) + (observed*w_2) + (survey*w_3)

$$\left(\frac{\sum_{s}^{e}\text{events}}{\sum_{s}^{e}(census_{dp}*benchmark_{dp})}*w_1\right)+(\text{observed}*w_2)+(\text{survey}*w_3)$$

where:

e=end date s=start date events=number of actual hand hygiene events dp=day part (e.g. first shift; second shift)

census=patients for the day part benchmark=expected activations for the day part w1=the weighting of the particular component. w1+w2+w3 must total to exactly 1.

w2=the weighting of the particular component. w1+w2+w3 must total to exactly 1.

w3=the weighting of the particular component. w1+w2+w3 must total to exactly 1.

Direct observation method=observed hand hygiene compliance. A whole number between 0 and 100 representing % compliance.

Patient survey method=patient survey hand hygiene compliance. A whole number between 0 and 100 representing % compliance.

The numerator is the sum of events for a predetermined time period.

The denominator represents the total number of expected hand hygiene events for a predetermined time period.

To calculate the denominator, first take the census for a day part multiplied by the benchmark for that day part. This yields the expected number of events for that day part. The expected events for each day part for the predetermined time period are then added together resulting in the total expected activations for the period of time defined by that start and end time.

The weightings are applied by multiplying the weighting by the Hand Hygiene compliance of the component.

There are three cases for calculating Hand Hygiene Compliance.

1) Dispenser Activation

In this case w1 is equal to 1 and there is no observed or survey Hand Hygiene component to the index.

2) Dispenser Activation and Either Survey or Observed data

In this case w1 and w2 or w3 will total to 1, and the index is calculated by multiplying the weighting by the compliance component. For example, group monitoring system recorded Hand Hygiene compliance for a period of time is 90 with a weighting of 0.8. Patient Survey compliance is 70 with a weighting of 0.2. With no observed data used for the calculation of the (hand hygiene compliance index) HHCI. Recorded Hand Hygiene Compliance is 90×0.8 or 72 and patient survey Hand Hygiene Compliance is 70×0.2 or 14. The Hand Hygiene Compliance Index for the period of time is 86, or 72+14.

3) Dispenser Activations with both Patient Survey and Observed Compliance Data

In this case w1+w2+w3 will total to 1, and the index is calculated by multiplying the weighting by the compliance component.

For example, the group monitoring system recorded hand hygiene compliance for a period of time is 90 with a weighting of 0.6. Patient survey compliance is 70 with a weighting of 0.2. and observed data compliance of 70 with a weighting of 0.2. Recorded hand hygiene compliance is 90×0.6 or 54 with patient survey hand hygiene compliance is 70×0.2 or 14 and observed compliance is 70×0.2 or 14. The hand hygiene compliance index for the period of time is 82, or 54+14+14.

It will be appreciated by those skilled in the art that there is a wide variety of ways that the information may be presented. A sample dashboard is shown at 130 in FIG. 5. The sample dashboard includes a graphical representation of the usage 132, a summary report 134 and a chart of specific dispenser usage 136.

Each dispenser has a unique identifier and the unique identifier which may be associated with a soap dispenser versus a sanitizer dispenser. It may be important to differentiate between hand hygiene events using soap versus sanitizer. This would be particularly important where the facility has a particular outbreak that requires soap versus sanitizer or vice versa such as with the disease causing organism clostridium difficile (also known as c. diff.) which is most difficult to eliminate in the spore form and can typically be removed from the hands only with hand washing as there is reliable data that supports the premise that hand sanitizers are not an effective way to kill c. diff. spores.

The system may be designed wherein the facility has the ability to adjust the benchmark or use a benchmark of its own choosing. It will be appreciated by those skilled in the art that the facility will have a wide range of reports that they can generate. For example it could generate reports by unit; by hospital; compare unit to unit; unit to hospital; or hospital to hospital by way of example. As well it will be appreciated by those skilled in the art that the dispenser usage data may be integrated with the facility purchasing department.

Figure 6:
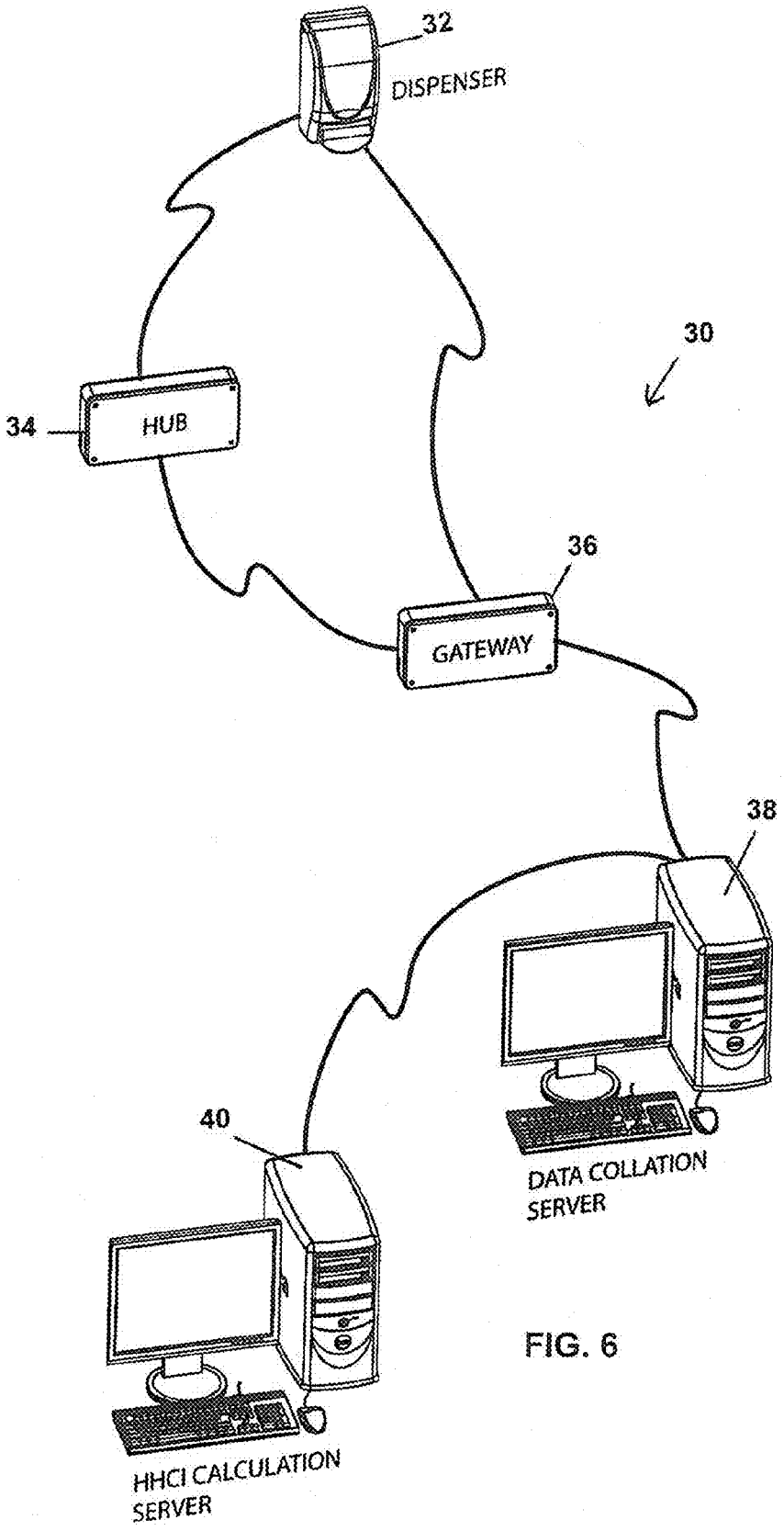
FIG. 6 is a diagram showing a wired dispenser data collection system.
Figure 7:
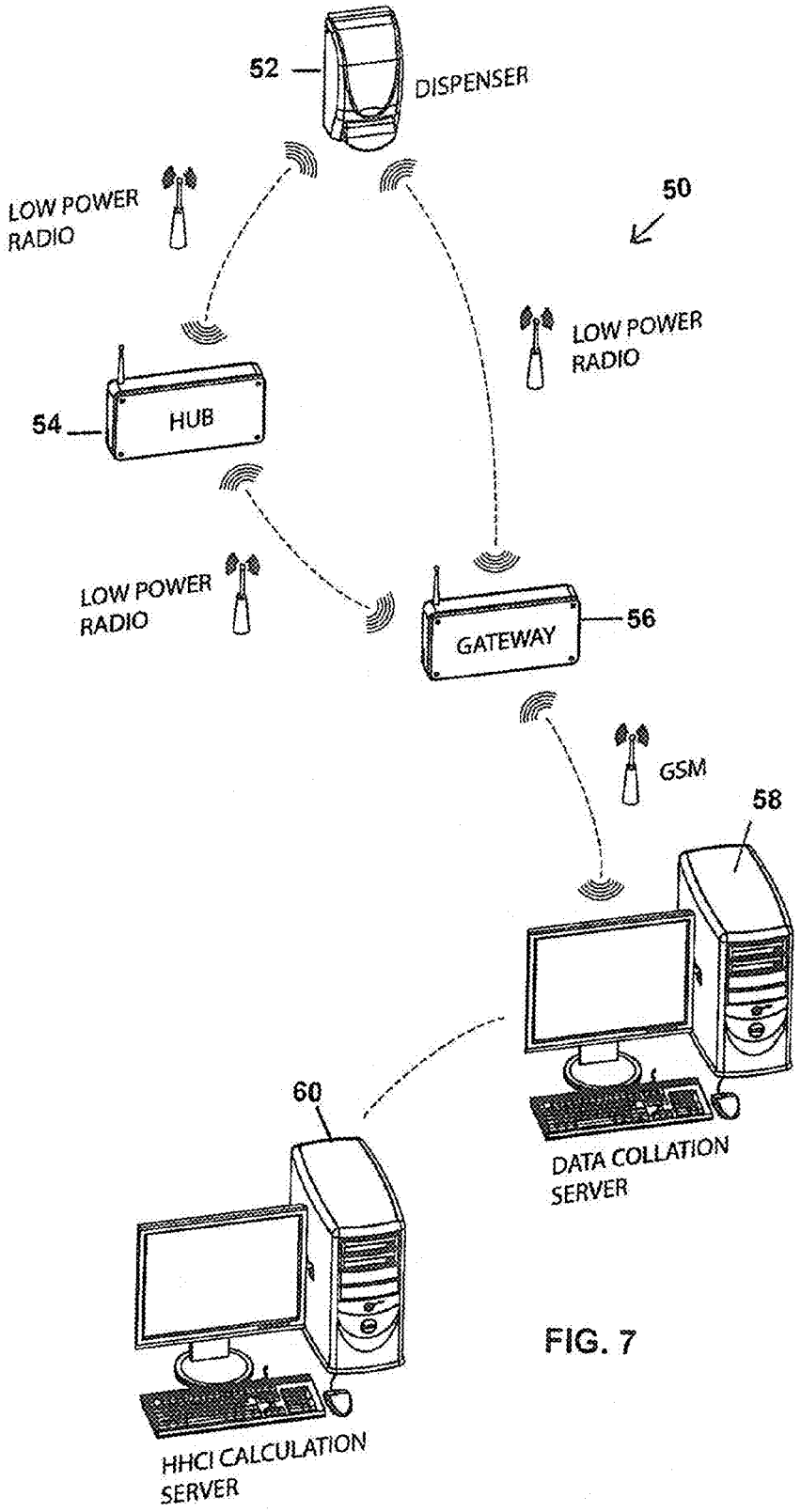
FIG. 7 is a diagram showing a wireless dispenser data collection system similar to that shown in FIG. 6.

The system may be connected with a wired system as shown at 30 in FIG. 6 or in a wireless system as shown at 50 in FIG. 7. In the wired system 30 a dispenser 32 is connected to a hub 34 and/or a gateway 36. The gateway is connected to the data collation server 38 which in turn is connected to a hand hygiene compliance index calculation server 40.

Similarly in the wireless system 50 the dispenser 52 is wirelessly connected to a hub 54 and/or a gateway 56. The gateway is wirelessly connected to a data collation server 58, preferably over the internet through GSM (Global System for Mobile Communications) or other communications standards and network protocol. The data collation server 58 is connected to a hand hygiene compliance index calculation server 60. It will be appreciated by those skilled in the art that the data collation server 58 and the hand hygiene compliance index calculation server 60 may be the same server. Each dispenser 52 has a sensor therein that preferably is capable of storing data in regard to up to 100 or more activations. It will be appreciated by those skilled in the art that 100 is by way of example only and that typically each dispenser may need to only store data relating to a few activations. This minimizes the chance of losing data in the event of queuing for receipt by the hub. The data is sent between the dispenser 52 and hub 54 and the hub 54 and gateway 56 in bursts which are either time or memory dependent. Preferably, data is sent from the gateway 56 to the server 58 in a burst by way of GSM. Data may be sent to an offsite server 60 for data processing.

When designing a wireless system there are a number of different considerations. Specifically there are only a limited number of frequencies that are generally available for "unlicensed" transmissions. The "unlicensed" frequencies that are available in each country may be different. The "unlicensed" frequencies may have a wide range of uses, for example they are used in tag security systems at retail stores, remote control devices for garages, Wi-Fi networks and many RFID tags (radio frequency identification device tags). Preferably the system described herein would use an "unlicensed" frequency. By way of example in the USA Title 47 Part 15 of the Code of Federal Regulations covers the use of "unlicensed" transmitters within the United States. Specifically, the table below shows the frequency and associated power levels that are generally available.

| Frequency Band | Power Level (dBm) | Power (mW) | Notes |
|---|---|---|---|
| 216 MHz-960 MHz | ~−10 dBm | 0.1 | Special conditions apply and certain exclusions and exemptions are available |
| 902-928 MHZ | 30 dBm | 1000 | Requires spread spectrum |
| 2400-2484 MHZ | 30 dBm | 1000 | Requires spread spectrum |

*200 uV/m equates to approximately −10 dBm when converted.

In contrast the European radio regulations are encapsulated by the R&TTE (Directive 1999/5/EC) and supported by CEPT Recommendation 70-03. Compliance with the R&TTE directive can be achieved in 2 ways the first is through the application of "Harmonized Standards" and the second by obtaining Notified Body Approval. The table below is based on recommendation CEPT70-03 and the Harmonized standards EN300-220 and EN300-440.

| Frequency Band | Power Level (dBm) | Power (mW) | Notes |
|---|---|---|---|
| 433.050-434.790 MHz | 10 dBm | 10 | <10% duty cycle |
| 433.050-434.790 MHz | 0 dBm | 1 | −13 dBm/ 10 kHz restriction |
| 433.040-434.790 MHz | 10 dBm | 10 | 25 kHz channel spacing |
| 863.870-870 MHz | 13.2 dBm | 20.9 | <0.1% duty cycle |
| 869.700-869.650 MHz | 27 dBm | 501 | <10% duty cycle |
| 2400-2483.5 MHz | 10 dBm | 10 | No restrictions |

The frequency and power that are chosen will affect the design of the system. A flow diagram showing the steps implemented in a low frequency (between 400 and 450 MHz) low power (up to 10 mW) wireless system is shown generally at 70 in FIG. 8. A similar flow diagram for a higher frequency (between 850 and 950 MHz), higher power (up to 1 W) wireless system is shown generally at 140 in FIG. 9.

Figure 8:
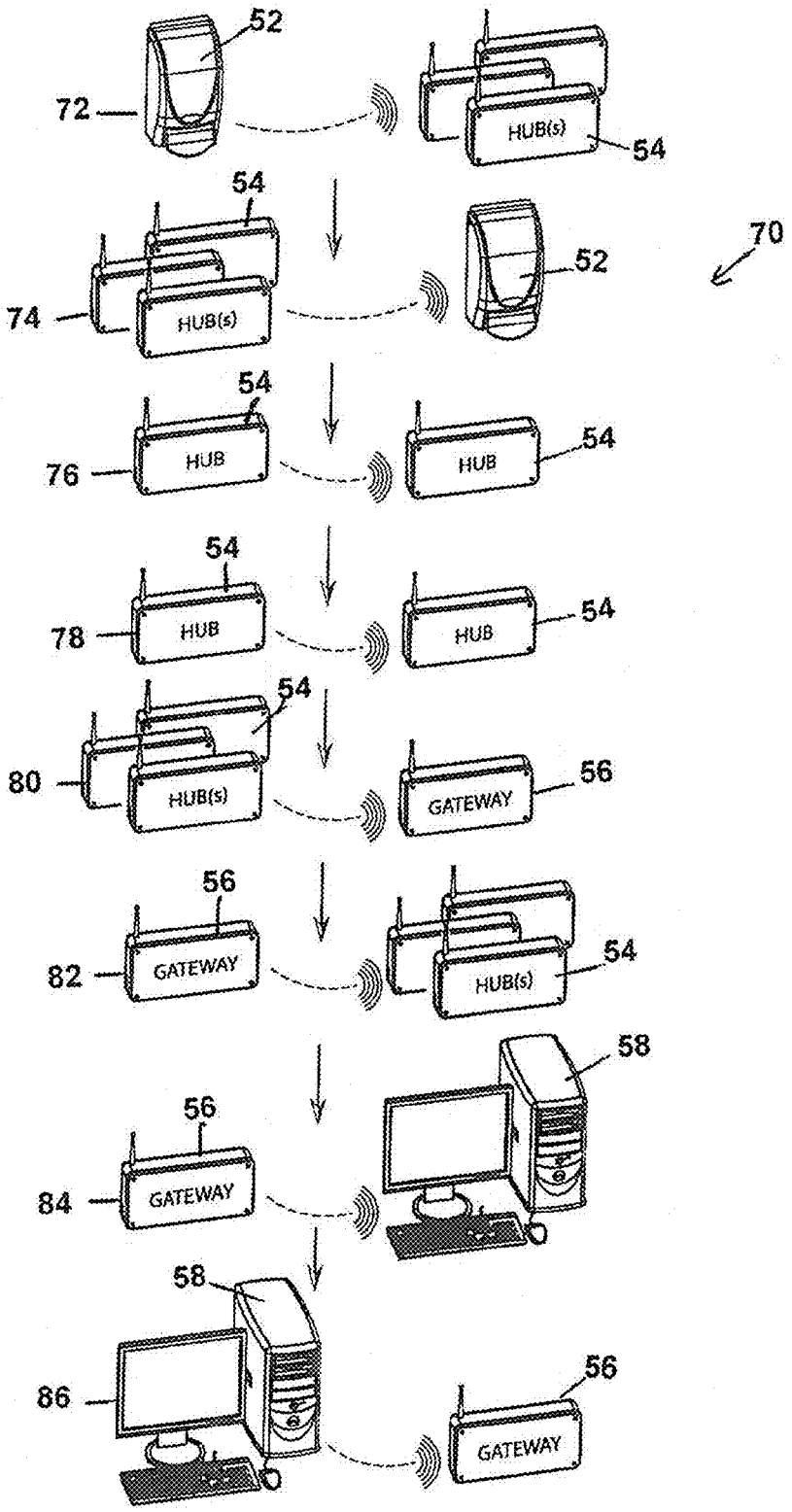
FIG. 8 is a flow diagram showing the steps in a low frequency, low power wireless dispenser data collection system.

A flow diagram showing the steps implemented a low frequency (between 400 and 450 MHz) low power (up to 10 mW) wireless system is shown generally at 70 in FIG. 8. Once there has been a dispenser usage event the dispenser 52 ID is transmitted to any and all hubs 54 within the transmission distance 72. On receipt of the dispenser ID transmission the hub(s) reply with an acknowledgement 74. This is sometimes referred to as a "handshake". If an acknowledgement is not received by the dispenser, the dispenser will retry until it is successful. The hub adds a date and time stamp to the ID to produce dispenser usage data. The hubs 54 send the dispenser usage data 76 on through the hub network unit it reaches a gateway 56. Each successive hub 54 in the chain acknowledges receipt of the dispenser usage data from the previous hub 78. If acknowledgement is not received by the originating hub it will retry until successful. The hubs 54 within the transmission distance of the gateway transmit the dispenser usage data through to the gateway 80. When the activation data is captured by the gateway 56, it transmits an acknowledgement back to the originating hub(s) 82. If an acknowledgement is not received by the originating hub, it will retry until successful. The gateway 56 collates all of the data it received from the rest of the system into transmission "packets" of a predetermined size. These data "packets" are transmitted to the data collation server 84. Preferably the data is sent to the collation server 58 over the internet and preferably via GSM. When the data "packet" is received or captured by the data collation server 58 an acknowledgement is sent back to the gateway 86. If an acknowledgement is not received by the gateway 56, it will retry until successful. This type of system is often referred to as a mesh network.

Figure 9:
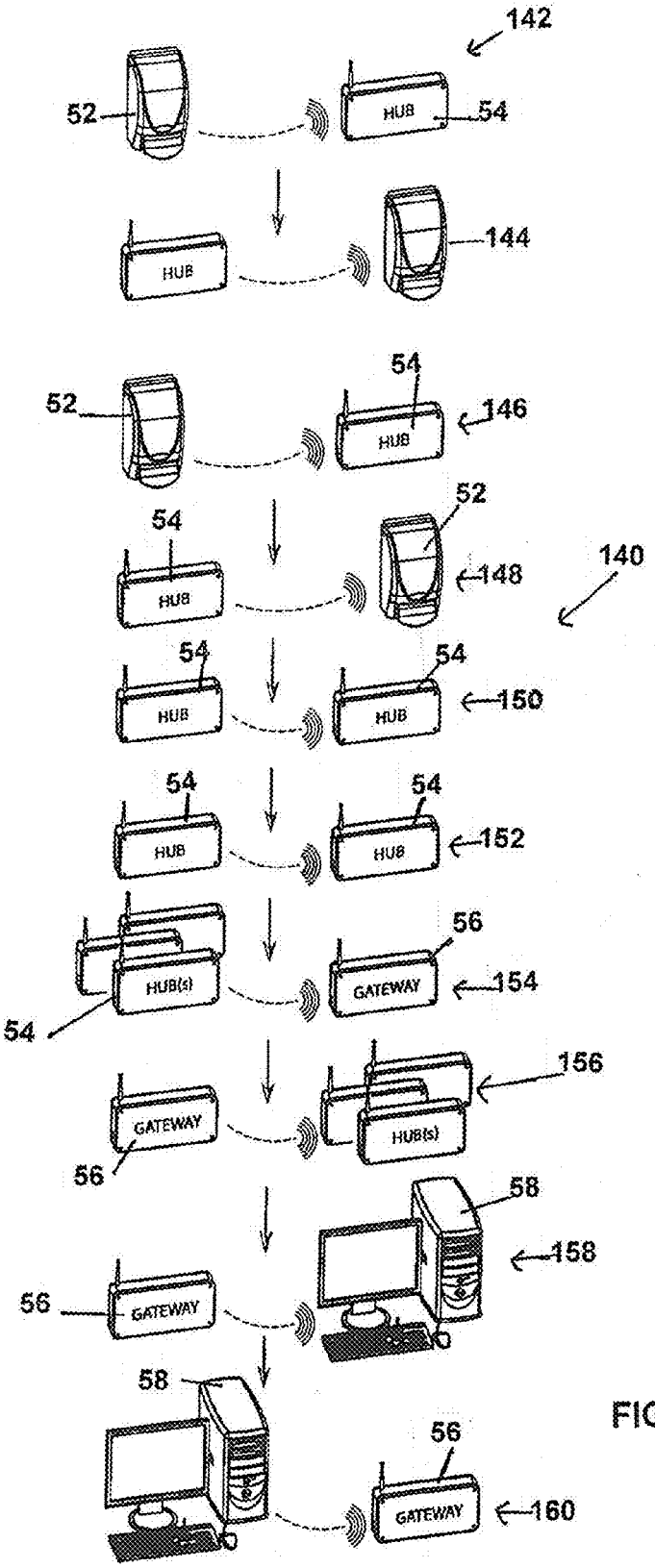
FIG. 9 is a flow diagram showing the steps in a higher frequency, higher power wireless dispenser data collection system.

Alternatively a higher frequency (between 850 and 950 MHz) and higher power (up to 1 W) system is shown generally at 140 in FIG. 9. On set up the dispenser 52 sends out a request to the nearest hub 54 for the hub's ID (identification) and a time update 142. The hub 54 responds with requested information 144 and this synchronizes to the dispenser. If the response is not received by the dispenser, it will retry until a successful synchronization is achieved. Once the set up is complete and there has been a dispenser usage event the dispenser 52 transmits to its synchronized hub 54 dispenser data including, dispenser ID, time, date of use, dispenser usage events 146. On receipt of the dispenser data the hub replies with an acknowledgement 148. The acknowledgement contains a time update. This is sometimes referred to as a "handshake". If an acknowledgement is not received by the dispenser, the dispenser will retry until it is successful. The hubs collate the data received from the dispensers to form a transmission "packet" of a predetermined size (predetermined number of bytes) 150. The data "packet is then transmitted through the hub network until it reaches the gateway 56. As the data "packet" is captured by the receiving hub it transmits an acknowledgement back to the originating hub 152. This acknowledgement also contains a time update. If an acknowledgement is not received by the originating hub it will retry until successful. The hubs 54, within transmission distance of the gateway 56, transmits the data "packets" to the gateway 154. As the data "packet" is captured by the gateway it transmits and acknowledgement back to the originating hub 156. This acknowledgement contains a time update. If acknowledgement is not received by the originating hub it will retry until successful. The gateway collates all of the data it received from the rest of the system into a transmission "packet" of a predetermined size (bytes) 158. This data "packet" is then transmitted via GSM to the data collection server 58. As the data "packet" is captured the data collation server transmits an acknowledgement back to the gateway 160. This acknowledgement also contains a time update. If an acknowledgement is not received by the gateway 56, it will retry until successful. This type of system is often referred to as a mesh network.

Figure 10:
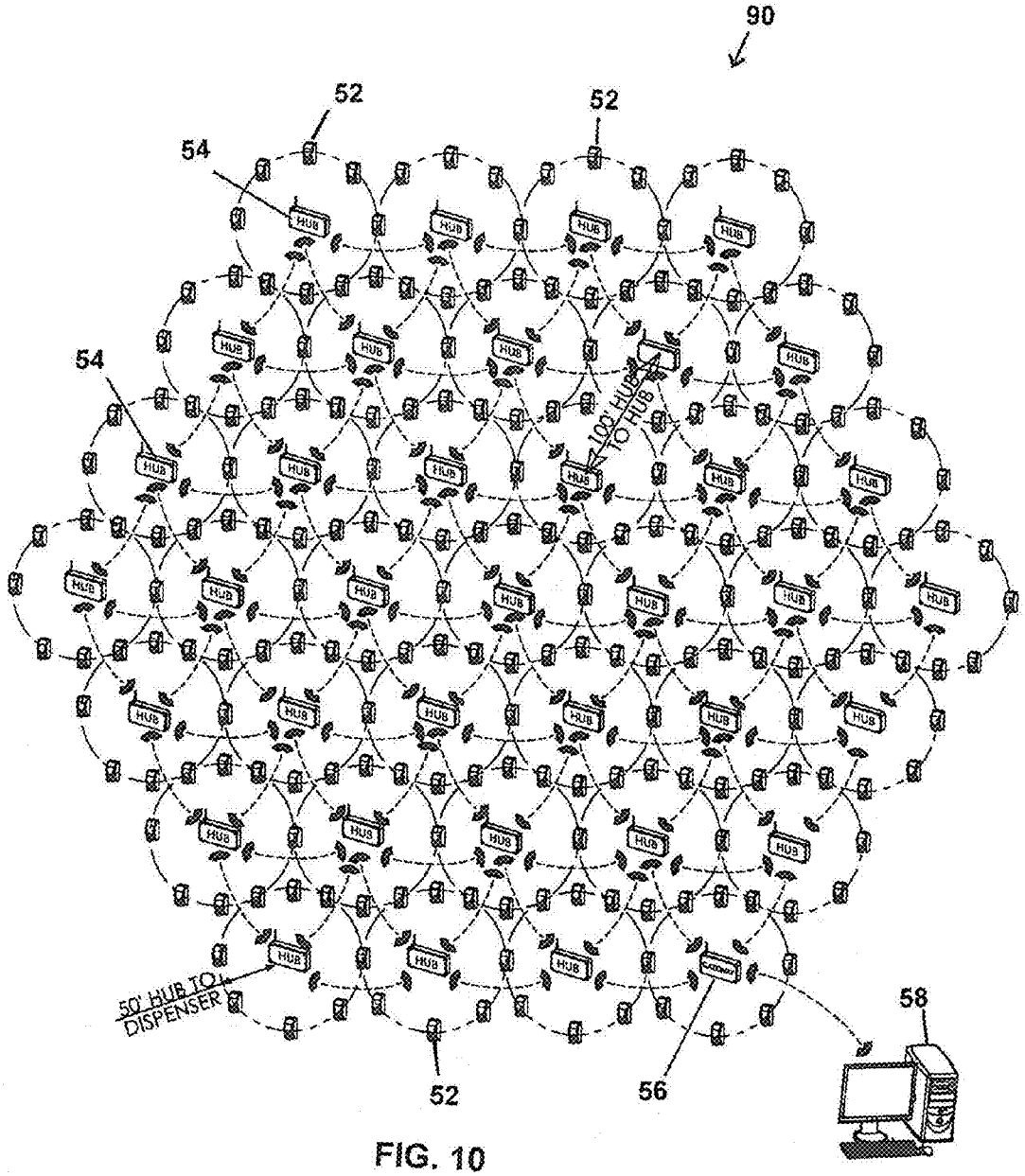
FIG. 10 is a diagram showing a lower power and lower frequency dispenser data collection system over a specific area.
Figure 11:
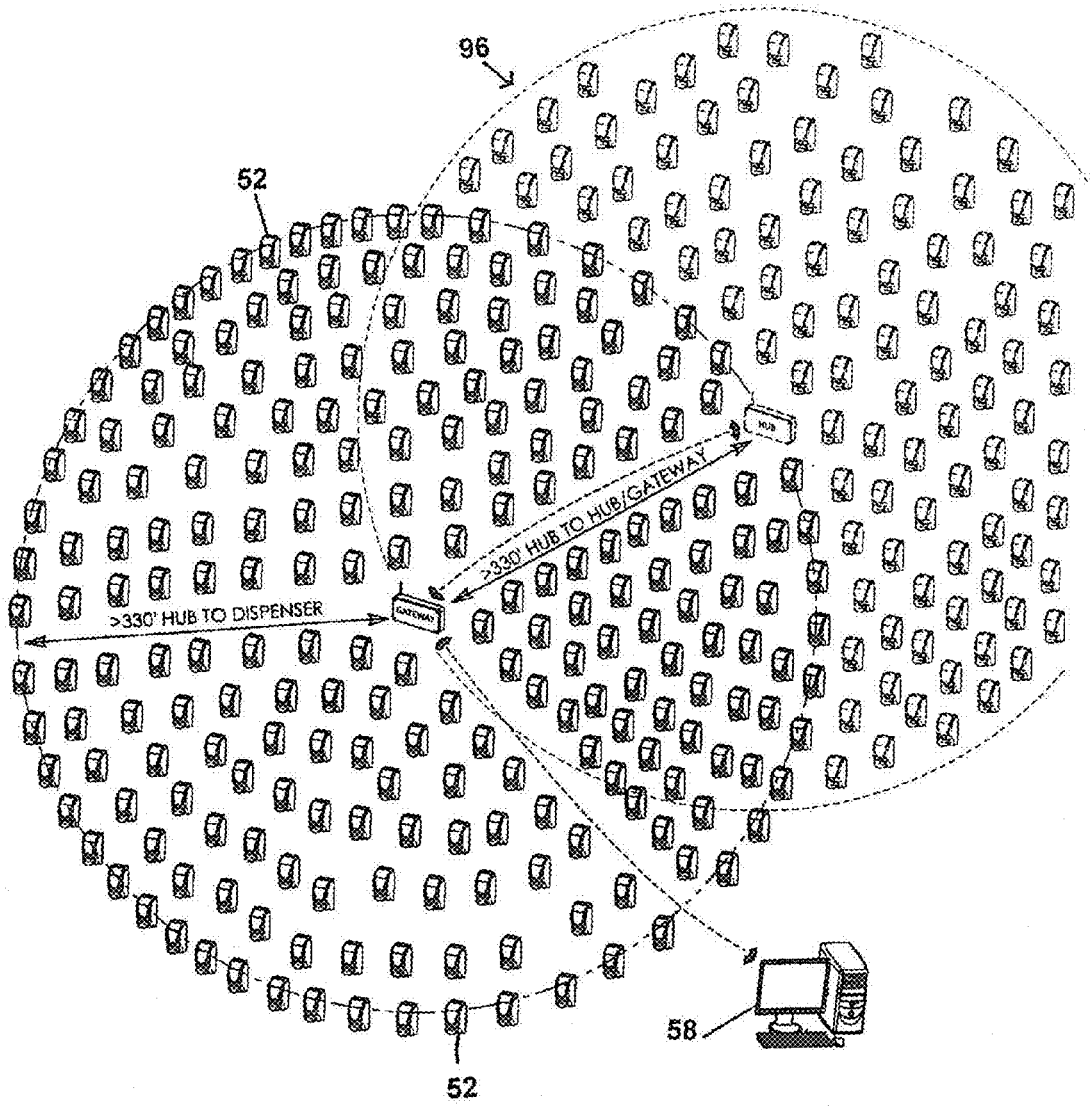
FIG. 11 is a diagram showing a higher power and higher frequency dispenser data collection system over the same specific area as covered in FIG. 10.

Referring to FIGS. 10 and 11, examples of dispenser data collection system are shown respectively at 90 and 96. A plurality of dispensers 52 are positioned around the unit of the facility being monitored. A plurality of receivers or hubs 54 are positioned around the unit within range of the dispensers such that each dispenser is in range of at least one receiver. As described above, when each dispenser 52 is used it will transmit its unique identification code, date and time to the hub or hubs 54, the hubs 54 in turn transmit the data to a gateway 56 and then to a server 58. Typically in a large facility the system uses a mesh network. At each stage of data transmission there will be a "handshake" between the transmitter and receiver whether that be dispenser and hub, hub and hub, hub and gateway or gateway and server. A handshake confirms the data is received and instructs the dispenser to delete the information from the memory. The server 36 may be on site or off site.

Accordingly, when designing the system herein for healthcare facility usage, for example a hospital, there are a number of competing interests. Specifically the system will require a plurality (100's or more likely 1,000's) of self (battery) powered activation sensors which need to reliably transmit usage data wirelessly around sprawling, cluttered hospital buildings and the data be transmitted via a GSM link(s) to the internet for external data manipulation: Each sensor's batteries preferably have long life (5+ years), are physically small (<a packet of cards) and preferably the system cost is low. The system must not interfere with medical equipment, be legal and preferably utilize license free radio frequencies.

An obvious solution is to use a low power+low cost+minimal RF interference, this suggests a system along the lines of a Zigbee®/Z Wave® type network architecture, utilizing ultra-low power transmitters (typically 0.1 mw) with minimal processing power. This gives low sensor hardware costs (currently approximately $5/node) and requires an electrical outlet powered network to be installed in each building to act as a communication and data processing 'backbone'. Knowledge of radio frequency propagation within buildings would lead those skilled in the art to select the lowest available frequency to maximize range for a given power output (reduces the hardwired 'backbone' costs and enhances reliable communications) and consequently he would preferably choose between 400 and 450 MHz. This would give a typical indoor range of 50 ft. Such a system is shown in FIG. 10 at 90. By way of example, in a facility that needs around 4000 dispensers, 200 hubs are required as shown in FIG. 10.

In contrast, legislation allows for higher power transmissions (c. 500 mw) when utilizing direct sequence spread spectrum techniques (DSSS) at higher frequencies (868-930 MHz dependant on location); this increases range (typically 330 ft) but also cost (currently approximately $11/node) and power consumption. However, in another embodiment shown in FIG. 11 at 96, it has been determined that the reduction in the density of the electrical outlet powered network backbone gives savings that at least offset the increase in sensor cost. The additional power requirements due to the 5,000 fold increase in transmission power are able to be offset by significantly more efficient firmware running in the sensor, enabled by the higher capacity microprocessor that is required to facilitate DSSS. For example by increasing unit cost and output power, in this embodiment there is a significantly decreased system cost and complexity without a noticeable battery life penalty (a single board mounted battery that fits within the space requirement gives preferably a life of 5 years+).

In system 96, between approximately 20 and 40 hubs is needed with around 4000 dispensers. The distance between the dispenser and the hub can be up to 5740 feet. However inside a healthcare facility the distances are more typically 330 feet and in some cases greater than 330 feet depending on the objects between the dispenser and the hub. Each hub can receive data from up to 10,000 dispensers. However, typically inside the healthcare facility each hub will receive data from around 200 dispensers. In system 96 the transmission power is up to 1000 milliwatts. With system 96 higher level data encryption can be used thereby providing a higher level of security than that afforded by the lower frequency system. System 96 uses direct sequence spread spectrum transmission techniques which has a reduced rate of interference and is allowed to operate at higher powers as compared to the lower frequency system.

Accordingly the higher frequency, generally between 850 and 950 MHz is advantageous over the lower frequency generally between 400 and 450 MHz system. The higher frequency system uses higher power and higher frequency which is opposite to conventional wisdom in regard to systems of data distribution of this type. Since the dispenser uses more power, some preliminary processing may be conducted at the dispenser.

A group monitoring system for dispenser usage compliance within a predetermined group of interest in a predetermined facility comprising the steps of: providing a plurality of dispensers, providing a dispenser data collection system operably connected to each dispenser, capable of providing information, the information including a unique dispenser identifier for each dispenser, a number of dispenser usage events that each dispenser was used; receiving the information from the data collection system and determining the predetermined group with which each dispenser is associated; determining the number of hand hygiene events within the predetermined group within a predetermined time period; determining a benchmark which corresponds to dispenser usage opportunities particular to the predetermined group and particular to the predetermined time period; calculating a dispenser usage compliance index particular to the predetermined group and particular to the predetermined time period by dividing the hand hygiene events for the predetermined group and the predetermined time period by a denominator, wherein the denominator equals the benchmark. The number of hand hygiene events within a predetermined time period equals a number of times the dispenser has been activated and wherein multiple activations within a predetermined activation period are considered a single dispenser usage event. It is not uncommon that when someone uses a dispensing system that rather than merely activating once they activate the dispenser multiple times. Accordingly to accurately determine the correct number of times that the dispenser has been used, the number of times the dispenser is activated needs to be determined. However where there are multiple activations within a predetermined activation period that is considered a single dispenser usage event.

The dispenser usage compliance index may further include at least one of direct observation data or survey data. The data used in the dispenser usage compliance index is weighted. The predetermined time period may correspond to a shift of the predetermined group in the predetermined facility.

The benchmark will likely vary depending on the predetermined facility, the type of unit in the facility, the time of day, and the day of the week. The denominator may also be the benchmark multiplied by census data. The census data will be dependent on the group of interest and may be bed occupancy, patient days, patient visits, the number of bed-hours of care or the staff. The predetermined group may be a bed, a room, a ward, a unit, a floor or a facility.

The dispenser data collection system uses a frequency of one of between 400 and 450 MHz system and between 850 and 950 MHz system. In one embodiment the dispenser data collection system uses a frequency between 850 and 950 MHz system and has a transmission power of up to 1000 milliwatts. It further includes a plurality of hubs for receiving data from the plurality of dispensers and each hub receives data from up to 10,000 dispensers and the distance between each dispenser and its associated hub is generally no greater than 5740 feet. The data between the dispenser and the hub is encrypted.

The group monitoring system for dispenser usage data collection includes a plurality of dispensers; a plurality of hubs each capable of receiving data from up to 10,000 dispensers; and wherein the distance between each dispenser and its associated hub is typically no greater than 5740 feet and the data is transmitted at between 850 and 950 MHz.

Generally speaking, the systems described herein are directed to a dispenser compliance system and by way of example a hand hygiene compliance system. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to a dispenser usage compliance system.

As used herein, the terms "comprises" and "comprising" are to be construed as being inclusive and open rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A group monitoring system for dispenser usage compliance within a predetermined group of interest in a predetermined facility type comprising steps of:

providing a plurality of dispensers, providing a dispenser data collection system operably connected to each dispenser, for providing information, the information including a unique dispenser identifier for each dispenser, a number of dispenser usage events that each dispenser was used;

providing a predetermined benchmark which corresponds to dispenser usage opportunities particular to the predetermined group and particular to a predetermined time period;

receiving the information from the data collection system and determining the predetermined group within which each dispenser is associated;

determining the number of dispenser usage events within the predetermined group and the predetermined time period;

determining census data particular to the predetermined group and particular to the predetermined time period;

calculating a dispenser usage compliance index particular to the predetermined group and particular to the predetermined time period by dividing the dispenser usage events for the predetermined group and the predetermined time period by a denominator wherein the denominator equals the predetermined benchmark multiplied by the census data.

2. The group monitoring system for dispenser usage compliance as claimed in claim 1 wherein the number of dispenser usage events within a predetermined time period equals a number of times the dispenser has been activated and wherein a plurality of activations within a predetermined activation period is considered a single dispenser usage event.

3. The group monitoring system for dispenser usage compliance as claimed in claim 2 wherein the predetermined activation period is between 1 and 4 seconds.

4. The group monitoring system for dispenser usage compliance as claimed in claim 1 wherein the information further includes a type of product in the dispenser.

5. The group monitoring system for dispenser usage compliance as claimed in claim 4 wherein the type of product is chosen from a group consisting of hand soap, sanitizer, lotion, cream, sunscreen and body wash.

6. The group monitoring system for dispenser usage compliance as claimed in claim 1 wherein the predetermined time period is chosen from a group consisting of a shift, and one of a weekday, a weekend day, and a holiday day, each of the predetermined group in the predetermined facility type.

7. The group monitoring system for dispenser usage compliance as claimed in claim 6 wherein the predetermined benchmark varies dependent on the predetermined facility type.

8. The group monitoring system for dispenser usage compliance as claimed in claim 7 wherein the predetermined facility type is one of a health care facility, a food processing facility, a food service facility, an educational facility and a manufacturing facility.

9. The group monitoring system for dispenser usage compliance as claimed in claim 8 wherein the predetermined facility type is chosen from a group consisting of a teaching hospital, a non-teaching hospital, a long term care facility, rehabilitation facility, a free standing surgical center, a health care professional office, a dental office, a veterinarian facility and a community care facility.

10. The group monitoring system for dispenser usage compliance as claimed in claim 9 wherein the predetermined benchmark varies dependent on predetermined group of interest.

11. The group monitoring system for dispenser usage compliance as claimed in claim 10 wherein the predetermined group of interest is chosen from a group consisting of medical unit, surgical unit, critical care unit, intensive care unit, emergency care unit, pediatric unit, emergency unit, outpatient unit, specialty care unit, dermatology unit, endocrinology unit, gastroenterology, internal medicine unit, oncology unit, neurology unit, orthopedic unit, ophthalmic unit, ear nose and throat unit, neonatal unit, obstetrics and gynecology unit, cardiac unit, psychiatric unit, post-operative recovery unit, radiology unit, plastic surgery unit and urology unit.

12. The group monitoring system for dispenser usage compliance as claimed in claim 11 wherein the predetermined group is chosen from the a group consisting of a bed, a room, a ward, a unit, a floor, a facility and a hospital group.

13. The group monitoring system for dispenser usage compliance as claimed in claim 12 wherein the census data is chosen from a group consisting of bed occupancy rate in the predetermined group, patient days in a predetermined group, patient visits in the predetermined group, bed-hours of care in the predetermined group and staff in the predetermined group.

14. The group monitoring system for dispenser usage compliance as claimed in claim 13 further including a step of determining a hand hygiene compliance index wherein the hand hygiene compliance index includes at least the dispenser usage compliance index.

15. The group monitoring system for dispenser usage compliance as claimed in claim 14 wherein the hand hygiene compliance index includes weighted information from the dispenser usage compliance index and one of survey compliance data and direct observation compliance data.

16. The group monitoring system for dispenser usage compliance as claimed in claim 14 wherein the hand hygiene compliance index includes weighted information from the dispenser usage compliance index and survey compliance data and direct observation compliance data.

17. The group monitoring system for dispenser usage compliance as claimed in claim 16 wherein the dispenser data collection system uses a frequency chosen from a group consisting of between 400 and 450 MHz system, between 850 and 950 MHz system and between 2.4 and 2.5 GHz.

18. The group monitoring system for dispenser usage compliance as claimed in claim 17 wherein the dispenser data collection system uses a frequency between 850 and 950 MHz system and has a transmission power of up to 1000 milliwatts.

19. The group monitoring system for dispenser usage compliance as claimed in claim 18 wherein each hub receives data from up to 10,000 dispensers and the distance between each dispenser and its associated hub is no greater than 5740 feet.

20. The group monitoring system for dispenser usage compliance as claimed in claim 16 wherein the dispenser data collection system is a hard wired system.

21. The group monitoring system for dispenser usage compliance as claimed in claim 20 wherein the dispenser data collection system further includes a plurality of hubs for receiving data from the plurality of dispensers.

22. The group monitoring system for dispenser usage compliance as claimed in claim 21 wherein the data is encrypted.

23. The group monitoring system for dispenser usage compliance as claimed in claim 1 wherein the predetermined benchmark varies dependent on the predetermined facility type.

24. The group monitoring system for dispenser usage compliance as claimed in claim 23 wherein the predetermined facility type is chosen from a group consisting of rehabilitation facility, a teaching healthcare facility, non-teaching healthcare facility, a chronic care facility, a community care facility, a school, and educational facility, a food service facility, a food processing facility, an outdoor work site and a commercial facility.

25. The group monitoring system for dispenser usage compliance as claimed in claim 24 wherein the predetermined benchmark varies dependent on predetermined group of interest.

26. The group monitoring system for dispenser usage compliance as claimed in claim 25 wherein the predetermined group of interest is chosen from a group consisting of medical unit, surgical unit, critical care unit, intensive care unit, emergency care unit, pediatric unit, emergency unit, outpatient unit, rehabilitation unit, long term care unit, specialty care unit, dermatology unit, endocrinology unit, gastroenterology, internal medicine unit, oncology unit, neurology unit, orthopedic unit, ophthalmic unit, ear nose and throat unit, neonatal unit, obstetrics and gynecology unit, cardiac unit, psychiatric unit, post-operative recovery unit, radiology unit, plastic surgery unit and urology unit.

27. The group monitoring system for dispenser usage compliance as claimed in claim 26 wherein the predetermined group is chosen from a group consisting of a bed, a room, a ward, a unit, a floor and a facility.

28. The group monitoring system for dispenser usage compliance as claimed in claim 27 wherein the census data is chosen from a group consisting of bed occupancy rate in the predetermined group, patient days in the predetermined group, patient visits in the predetermined group, bed-hours of care in the predetermined group and staff in the predetermined group.

29. The group monitoring system for dispenser usage compliance as claimed in claim 1 wherein the dispenser data collection system uses a frequency chosen from a group consisting of between 400 and 450 MHz system, between 850 and 950 MHz system and between 2.4 and 2.5 GHz.

30. The group monitoring system for dispenser usage compliance as claimed in claim 29 wherein the dispenser data collection system uses a frequency between 850 and 950 MHz system and has a transmission power of up to 1000 milliwatts.

31. The group monitoring system for dispenser usage compliance as claimed in claim 30 wherein the dispenser data collection system further includes a plurality of hubs for receiving data from the plurality of dispensers.

32. The group monitoring system for dispenser usage compliance as claimed in claim 31 wherein each hub receives data from up to 10,000 dispensers and the distance between each dispenser and its associated hub is no greater than 5740 feet.

33. The group monitoring system for dispenser usage compliance as claimed in claim 32 wherein the data is encrypted.

34. The group monitoring system for dispenser usage compliance as claimed in claim 1 wherein the census data is chosen from a group consisting of bed occupancy rate in the predetermined group, patient days in a predetermined group, patient visits in the predetermined group, bed-hours of care in the predetermined group and staff in the predetermined group.

35. The group monitoring system for dispenser usage compliance as claimed in claim 1 further including a step of determining a hand hygiene compliance index wherein the hand hygiene compliance index includes at least the dispenser usage compliance index.

36. The group monitoring system for dispenser usage compliance as claimed in claim 35 wherein the hand hygiene compliance index includes weighted information from the dispenser usage compliance index and one of survey compliance data and direct observation compliance data.

37. The group monitoring system for dispenser usage compliance as claimed in claim 35 wherein the hand hygiene compliance index includes weighted information from the dispenser usage compliance index and survey compliance data and direct observation compliance data.

* * * * *

UNITED STATES PATENT AND TRADEMARK OFFICE

CERTIFICATE OF CORRECTION

PATENT NO. : 8,427,323 B2
APPLICATION NO. : 12/823475
DATED : April 23, 2013
INVENTOR(S) : Alper et al.

It is certified that error appears in the above-identified patent and that said Letters Patent is hereby corrected as shown below:

In the Claims,

Col. 19, line 20, on the Letter Patent, claim 12 incorrectly includes the phrase "the a group," where it should only read "a group," per the examiner's amendment. Claim 12 should correctly read:

The group monitoring system for dispenser usage compliance as claimed in claim 11 wherein the predetermined group is chosen from a group consisting of a bed, a room, a ward, a unit, a floor, a facility and a hospital group.

Col. 19, line 59, on the Letter Patent, claim 19 is incorrectly dependent on claim 18. As the claims are arranged on the Letter Patent, claim 19 should be dependent on claim 21, such that claim 19 reads:

The group monitoring system for dispenser usage compliance as claimed in claim 21 wherein each hub receives data from up to 10,000 dispensers and the distance between each dispenser and its associated hub is no greater than 5740 feet.

Signed and Sealed this
Tenth Day of March, 2015

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,427,323 B2
APPLICATION NO. : 12/823475
DATED : April 23, 2013
INVENTOR(S) : Alper et al.

It is certified that error appears in the above-identified patent and that said Letters Patent is hereby corrected as shown below:

In the Claims,

Col. 19, line 20, on the Letter Patent, claim 12 incorrectly includes the phrase "the a group," where it should only read "a group," per the examiner's amendment. Claim 12 should correctly read:

The group monitoring system for dispenser usage compliance as claimed in claim 11 wherein the predetermined group is chosen from a group consisting of a bed, a room, a ward, a unit, a floor, a facility and a hospital group.

Col. 19, line 59 - Col. 20, line 2 should read:

19. The group monitoring system for dispenser usage compliance as claimed in claim 16 wherein the dispenser data collection system is a hard wired system.

20. The group monitoring system for dispenser usage compliance as claimed in claim 19 wherein the dispenser data collection system further includes a plurality of hubs for receiving data from the plurality of dispensers.

21. The group monitoring system for dispenser usage compliance as claimed in claim 20 wherein each hub receives data from up to 10,000 dispensers and the distance between each dispenser and its associated hub is no greater than 5740 feet.

This certificate supersedes the Certificate of Correction issued March 10, 2015.

Signed and Sealed this
Ninth Day of June, 2015

Michelle K. Lee

Michelle K. Lee
*Director of the United States Patent and Trademark Office*